US005360214A

United States Patent [19]

Harmen

[11] Patent Number: 5,360,214

[45] Date of Patent: Nov. 1, 1994

[54] SPOKE-WHEEL RANDOM OBJECT SELECTOR GAMING APPARATUS

[76] Inventor: Larry V. Harmen, 4606 Eggers Dr., Fremont, Calif. 94536

[21] Appl. No.: 190,271

[22] Filed: Feb. 2, 1994

[51] Int. Cl.[5] ..... A63F 5/02

[52] U.S. Cl. ..... 273/144 B; 273/142 E; 273/144 A

[58] Field of Search ..... 273/142 G, 144 B, 144 A, 273/144 R, 145 C, 142 E, 142 F, 142 JA

[56] References Cited

U.S. PATENT DOCUMENTS

| | | | |
|---|---|---|---|
| D. 151,385 | 10/1948 | Nagel et al. | 273/142 G |
| 1,990,859 | 2/1935 | Elliott | 273/142 G |
| 4,280,702 | 7/1981 | Tremblay | 273/144 B |
| 4,403,775 | 9/1983 | Chaput | 273/144 B |
| 4,465,278 | 8/1984 | Massina et al. | 273/144 B |
| 4,813,676 | 3/1989 | Weatherspoon | 273/144 A |
| 4,834,385 | 5/1989 | Jackson | 273/144 A |
| 5,102,138 | 4/1992 | Johnson | 273/144 B |
| 5,265,877 | 11/1993 | Boylan et al. | 273/144 B X |

FOREIGN PATENT DOCUMENTS

| | | | |
|---|---|---|---|
| 526925 | 10/1921 | France | 273/142 E |
| 2382059 | 10/1978 | France | 273/144 B |

*Primary Examiner*—William E. Stoll
*Attorney, Agent, or Firm*—Thomas E. Schatzel

[57] ABSTRACT

A gaming apparatus including a rigid circular ring with a plurality of hollow spokes projecting radially from a central hub having a cylindrical cavity with passageways from said cavity to each of said spokes.

13 Claims, 1 Drawing Sheet

SPOKE-WHEEL RANDOM OBJECT SELECTOR GAMING APPARATUS

BACKGROUND OF THE INVENTION

1. Field of the Invention

This invention relates generally to gaming apparatus for selecting numbers, letters or other designations. More particularly, but not by way of limitation, this invention relates to a rotary gaming apparatus for mixing and randomly selecting numbered objects for which a player may wager will come to rest at the bottom of a well in a spoke.

2. Description of the Prior Art

Casino and lottery games have been popular for many years. Many games such as keno, bingo, and lotteries, involve the random selection of several numbered balls from a larger pool of numbered balls within a hollow cylindrical cage. Such gaming apparatus allows a participant to mechanically pick out random numbered balls from said cage.

The axis of the cage apparatus is mounted to a support surface to allow rotation. As the cage apparatus rotates, numerically numbered globes randomly bounce about inside. When the apparatus stops moving the globes settle inside slots from which the winning number and color is determined. The support, apparatus, and globes may take on various shapes depending upon the participant's desire.

Exemplary prior art which makes use of random selection of a particular number of balls from a particular group of balls includes U.S. Pat. No. 4,373,728 issued to Willi Korzenietz, and U.S. Pat. No. 4,813,676 issued to Wallace Weatherspoon, both of which require several additional moving parts in order to determine the chosen globes.

U.S. Pat. No. 5,102,138 issued to Robert J. Johnson, relates to a portable apparatus which allows globes to stay within a primary area of the apparatus to determine the winning globes. However, U.S. Pat. No. 5,102,138 utilizes only the globe's number to determine a winning number.

SUMMARY OF THE PRESENT INVENTION

It is therefore an object of the present invention to provide a rotational gaming apparatus for a thorough mixing and random dispensing of individually identifiable objects.

Another object of the present invention is to provide a rotational gaming apparatus that has no necessary moving parts except for rotation about a central axis.

Another object of the present invention is to provide a rotational gaming apparatus such that a winning number constitutes the combination of an individually identifiable object within a select location of said apparatus and an identifiable segment of the apparatus.

Another object of the present invention is to provide a quick, simple, and entertaining gaming method to determine winning numbers.

Another object of the present invention is to provide a reliable and economical gaming method to determine winning numbers.

It is another object of the present invention to provide a gaming device for casinos which is rotational at a fixed location.

It is another object of the present invention to provide an interesting and entertaining game to observe as well as to participate.

Briefly, a preferred embodiment of the present invention includes a rigid circular ring having an axial center, an outside peripheral wall, an inside peripheral wall, a plurality of hollow spokes projecting from the inside wall towards an axial center and joined to a hub having a hollow cylindrical interior cavity for receiving a plurality of specifically identified objects. The ring is rotatable about an axis common to the axial center. As the ring is rotated the objects thoroughly mix within the chamber and enter and leave the spokes due to gravitational pull. The face of the ring is further segmented into specifically identified sectors. A sector identification peg, e.g. pointer or clicker, projects from a board adjacent the ring to specifically identify one sector when the ring is at rest.

An advantage of the present invention is that it has essentially one moving part, namely a spoked-wheel movable about a fixed axis which allows it to be simple to use and to maintain.

Another advantage of the present invention is that it allows for a large variety of potential combinations while requiring minimal identifiable objects.

Another advantage of the present invention is that it provides a gaming apparatus which is simple to learn and to actually visualize as the winning identifiable object is being determined.

Another advantage of the present invention is that it provides a gaming apparatus which provides for thorough mixing and random dispensing of individually identifiable objects.

Another advantage of the present invention is that it provides a rotational gaming apparatus wherein the winning number constitutes a combination of an individually identifiable object within a select location of said apparatus and a select identifiable segment of the apparatus.

Another advantage of the present invention is that it provides for a gaming device for play in casinos and which is rotational at a fixed location visible to all participants.

These and other objects and advantages of the present invention will no doubt become obvious to those of ordinary skill in the art after having read the following detailed description of the preferred embodiment which is illustrated in the various drawing figures.

DETAILED DESCRIPTION OF THE PREFERRED EMBODIMENT

Figure 1:
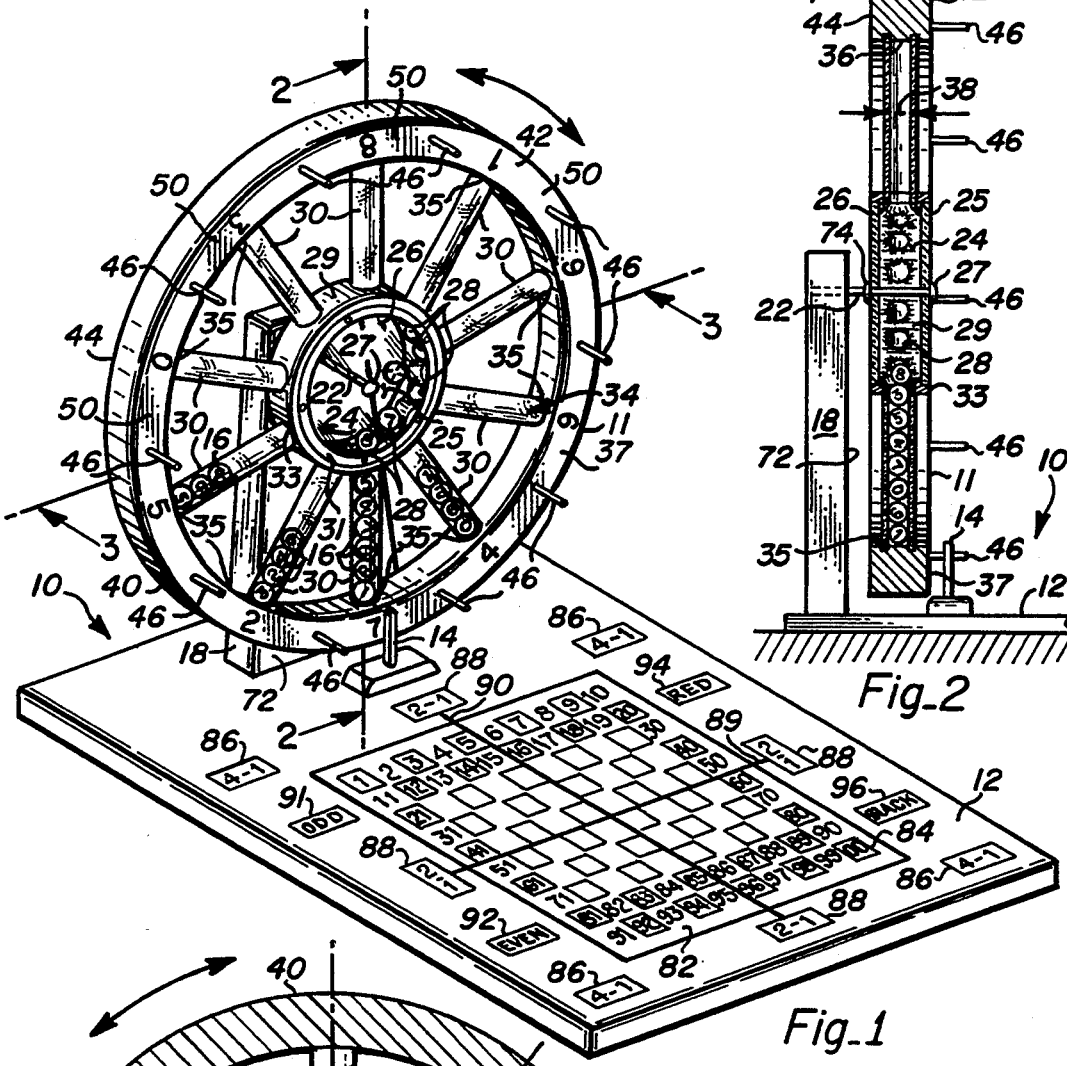
FIG. 1 is a perspective view of a gaming apparatus incorporated with a support stand and a wagering board.

FIG. 1 shows a perspective view of a rotational gaming apparatus of the present invention and referred to by the general reference number 10. The gaming apparatus 10 includes a rotational spoke-wheel random number selector 11, a wagering board 12, a sector identification peg 14, e.g. pointer or clicker, a plurality of numbered spherical objects 16, and a support stand 18 for mounting and supporting the spoke-wheel random number selector 11 adjacent to the board 12 and the identification peg 14.

The spoke-wheel random number selector 11 contains an elongated axle 22 which projects laterally from the stand 18 and extends transversely through, and coaxial with the center of the spoke-wheel random number selector 11. The selector 11 includes a transparent cylindrical, hollow hub 24 formed by a pair of transparent, plastic, circular walls 25 and 26. The axle 22 extends coaxially through the hub 24 with an end 27 supported about the front wall 25, preferably plastic of hollow hub 24. It is not necessary that the axle 22 extend through the hub 24 but could be fixed to the wall 26. The purpose of the axle 22 is to allow the hub 24 to smoothly rotate around the axis of the axle 22 and to support the selector 11 at an elevated position and in a vertical plane. The transparent hollow hub 24 forms a cylindrical interior cavity with ten hollow passageways 28 evenly spaced apart every thirty-six degrees around the circumference of the hub's inside rear wall 26, and radially projecting therefrom through a cylindrical wall 29. Alternative embodiments may include a different number of spokes, e.g. six or twelve to coincide with the number of faces on one or two dice and then six or twelve objects 16.

The hub 24 receives a plurality, e.g. twenty-one spherical objects 16. Each of the ten passageways 28 open to the interior of the cavity of hub 24 and are bevelled to facilitate the easy flow of the spherical objects 16 from the hub 24 into the passageways 28. Joining the exterior cylindrical wall 29, around the circumference of the hub 24, are ten identical tubular passageways 30 located thirty-six degrees apart and coaxial with one of the interior passageways 28. The planar surface of the front 25 and rear 26 walls of the hub 24 are perpendicular to the axle 22 with their circumferential edge sealed to the cylindrical wall 29. Thus, the cavity within the hub 24 is of a true cylindrical interior with the only access being through the passageways 28.

Figure 2:
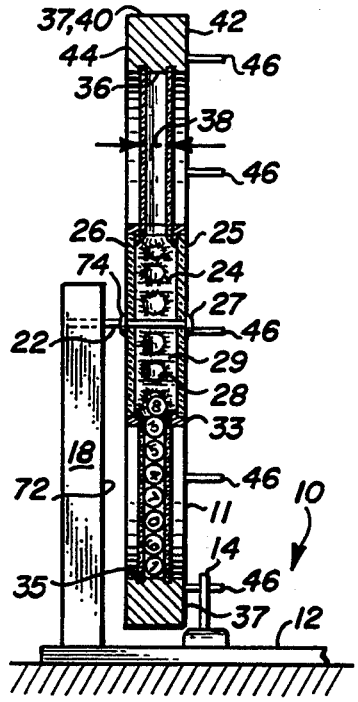
FIG. 2 is a cross-sectional view of the spoke-wheel random number selector, support stand, and wagering board taken along the line 2—2 of FIG. 1.
Figure 3:
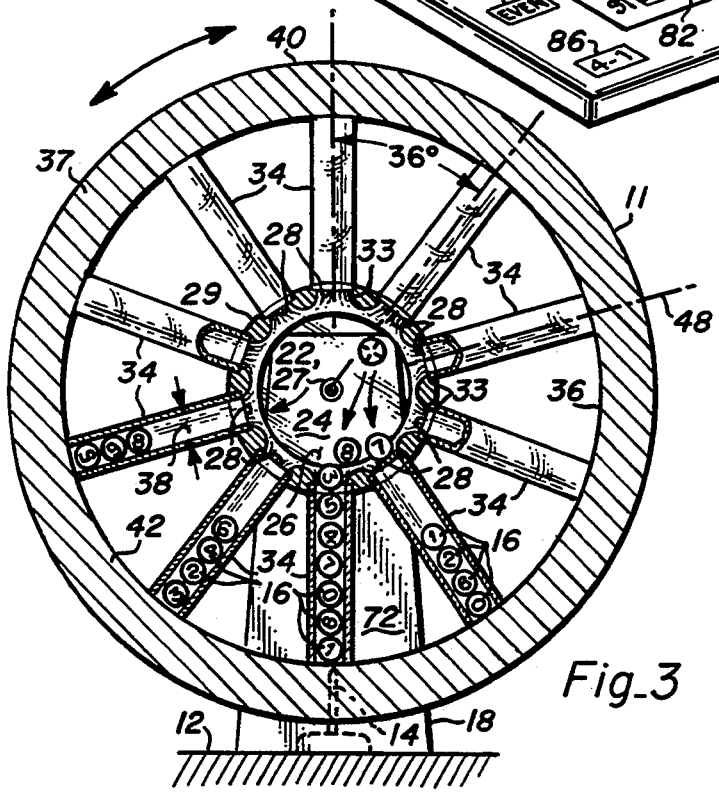
FIG. 3 is a cross-sectional view of the spoke-wheel random number selector, support stand, and wagering board of FIG. 2 taken along the line 3—3.

Each of the ten exterior passageways 30 is formed by a transparent hollow tube with a first end 33 fused to one of the passageway 28 to form a transparent spoke 34. A second end 35 of each spoke 34 is secured to a solid interior peripheral wall 36 of a rigid circular ring 37, coaxial with the axle 22. Each of the hollow transparent spokes 33 have an interior diameter 38 equivalent to the diameter of the ten passageways 28. The length of the ten hollow spokes 34 are enough to contain at least one spherical object 16. FIG. 1, FIG. 2, and FIG. 3 illustrate the length of each transparent hollow spoke 34 capable of containing up to eight spherical objects 16. Thus, the diameter of each of the objects 16 is slightly less than the diameter of passageways 28, the diameters 38 and the length of the spokes 34, and the length of the spokes 34 is approximately eight times such diameter.

The circular ring 37 includes the interior wall 36, an exterior peripheral wall 40, a front face wall 42, and a rear wall 44. The walls 36 and 40 are approximately two inches apart. Protruding from the front wall 42 are a plurality of dividers 46 in the form of pegs. Each of the ten dividers 46 are located thirty-six degrees apart and midway between the axis of two adjacent spokes 34. The spacing between each divider 46 forms individually identifiable sectors 50. Each of the sectors 50 are individually numerically identified by marking the numbers "0", "1", "2", "3", "4", "5", "6", "7", "8", or "9" on the individual sectors such that each of the ten sectors 50 contains a different number approximately one and one half inch tall and is individually identifiable.

Contained inside the transparent hollow hub 24 and the ten transparent hollow spokes 34 are twenty-one spherical objects 16. With the circumference of each spherical object 16 being equal, and less than the inside diameter of the spokes 38, and large enough so that only one spherical object 16 can penetrate the passageways 28 at any given moment, only one spherical object 16 can enter any spoke 34 and come into contact with the interior wall 36 of the circular ring 37 at any one time. Twenty objects 16 are a common color, e.g. white, and one object 16 is colored, e.g. green. Each of the objects 16 carry a number "0", "1", "2", "3", "4", "5", "6", "7", "8", or "9" on it's exterior. Two spherical objects 16 have the same number such that there are two objects for each of the numerals 0–9. The green spherical object 16 has no number. Thus, between the various numbers and the unnumbered object 16, each spherical object 16 is uniquely identifiable.

The spoke-wheel random number selector 11 is mounted by way of the axle 22 to the stable and immobile support stand 18. The support stand 18 can take on various forms such as a wall, apparatus 10 illustrates the support stand 18 as a pedestal with a front wall 72 having a planar face parallel to the face of the spoke-wheel random number selector 11 and located behind the rear wall 44 of the circular ring 37. A lock ring 74 engaged to the axle 22 and positioned between the front wall 72 of the support stand 18 and the spoke-wheel random number selector 11 prevents the selector 11 from contacting the support stand 18 at any time. The ring 74 allows the selector 10 to rotate freely around the axle 22 without interference from the support stand 18. The support stand 18 is secured to the immobile and stable board 12.

Attached to the wagering board 12 and directly adjacent to the exterior 40 and front wall 42 of the circular ring 37 is the sector identification peg 14. The sector identification peg 14 is made from a flexible elongated piece of material, and is perpendicular to the top surface of the wagering board 18. The length of the sector identification peg 14 is selected to protrude from the wagering board 12 past circumferential path of the dividers 46. The flexible material of which the sector identification peg 14 comprises allows the ten dividers 46 to move past the sector identification peg 14 as it is rotated with rotational force. The purpose for the sector identification peg 14 is to identify which sector 50 contains the chosen spherical object 16 and the number of the chosen sector 50 when the rotational force is dissipated and the selector 11 comes to rest. The winning number is determined after a person rotates the selector 11, allows the selector 11 to rotate freely until there is no more momentum, and the selector 11 stops moving. While the selector 11 rotates, the twenty-one spherical objects 16 randomly bounce, tumble and move within the cavity of the hub 24 and the interconnected ten spokes 32 due to gravity and momentum. When the selector 11 stops rotating the sector identification peg 14 will be in an identifiable numbered sector 50 between two of the dividers 46. Because the chosen numbered sector 50 is located at the bottom of the spoke-wheel random number selector 10, the spherical objects 16 will gravitate down the chosen spoke 34 within the chosen sector 50. Because there are ten different numbered sectors 50, and ten different numbered spherical objects 16, there will be one hundred possible winning numerical combinations (0–99). The winning number is determined with the number printed on the chosen sector 50 being the first digit, and the second digit being the number on the object 16 in contact with the interior wall 36 and the end of spoke 34 in the sector 50 adjacent to the peg 14. For example, in FIG. 1 the winning number is "71". If the winning object 16 is the green colored one, then all wagers belong to the person who spun the selector 11.

The wagering board 12 is where participants place wagers. FIG. 1 illustrates the wagering board 12 as including a square grid 82 containing one hundred square sectors 84. Each sector 84 contains an individually identifiable number and one of two colors. For example, in alternative rows each odd numbered sector 84 may be colored black and each even numbered sector 84 may be colored red, while in the other alternative rows each odd numbered sector 84 is red and each even numbered sector is black. The top left corner sector is numbered "1" and the numbers increase in increments of "1" from left to right. When the farthest right square is numbered the numbering continues in increments of "1" at the row adjacent to the previous row's lower side, and continues from left to right. This method of numbering continues for ten rows until the bottom right, corner sector 84 contains the number "00". These one hundred numbers represent the possible combinations that the numbered spherical objects 16 and numbered sectors 50 on the circular ring 37 can combine to create. If the green spherical object is the chosen spherical object 16, all wagers are property of the person who rotates the selector 11.

In addition to the grid 82, the wagering board 12 includes a set of four rectangular areas labeled "4-1" 86 which are located along a diagonal axis of the grid 82, and approximately one inch from the corners of the grid 82. The wagering board 12 also includes a set of four rectangular areas labeled "2-1" 88 which are located along a horizontal axis 89 or vertical axis 90 through the center of the grid 82, and approximately one inch from the grid 82. The wagering board 12 includes a set of four rectangular areas labeled "odd" 91 "even" 92, "red" 94, and "black" 96. FIG. 1 illustrates the "odd" area 91 as located approximately two inches to the left of the square labeled "11", the "even" area 92 as located approximately two inches to the left of the square labeled "81", the "red" area 94 as located approximately two inches to the right of the square labeled "20", and the "black" area 96 as located approximately two inches to the right of the square labeled "90".

Wagers are conducted by participants placing money on the wagering board 12 at various locations. The four rectangular "4-1" areas 86 are for participants who desire to wager that the quadrant of the grid 82 nearest such selected "4-1" area 86 will contain the winning number. The four "2-1" areas 88 are for participants who desire to wager that the half of the grid 82 closest to such selected "2-1" 88 area will contain the chosen number. The "odd" areas 91 and "even" areas 92 are for participants who desire to wager that the winning number will be odd or even. The "red" areas 94 and "black" areas 96 are for participants who desire to wager that the winning number will be red or black. In an alternative embodiment all of the sectors 84 may be of a common and neutral color but with the numbered objects 16 being colored either red or black. For each of the numerals 0–9 there is a black object 16 and a red object 16.

Although the present invention has been described in terms of the presently preferred embodiment, it is to be understood that such disclosure is not to be interpreted as limiting. Various alternations and modifications will no doubt become apparent to those skilled in the art after reading the above disclosure. Accordingly, it is intended that the appended claims be interpreted as covering all alterations and modifications as fall within the true spirit and scope of the invention.

I claim:

1. A gaming apparatus for mixing and randomly selecting individually identifiable spherical objects comprising:

a least one spherical object;

a rigid circular ring having an axial center, outside peripheral wall and an inside peripheral wall with a face wall interconnecting said outside peripheral wall and said inside peripheral wall;

a plurality of hollow spokes connected to said inside peripheral wall and projecting towards said axial center;

a central hub having a hollow interior and coaxial with said axial center for receiving a plurality of objects;

an axial coaxial with said axial center engaged to the hub with the hub being rotatable about the axle;

the hub being connected to each of the spokes and including passageways extending from said hollow interior to an interior of said spokes, with each of said hollow spokes having one end communicating directly into one of said passageways and a second end abutting said inside peripheral wall of the ring; and a divider means protruding from said face for forming a plurality of individually identifiable ring sectors about said circular ring.

2. The apparatus of claim 1 further including a support stand anchored with the axle, the axle projecting laterally from the stand and at an elevated position to support the ring in a vertical plane.

3. The apparatus of claim 2 wherein each of said objects are spherical of a predetermined number and of a diameter less than the size of said passageways, said objects being moveable into and out of said hub and spokes through said passageways whereby said objects will gravitate into said spokes, striking the inner walls of the hub and spokes and mixing as they move in respect to rotation of the ring so that when the ring stops moving at least some of said objects will rest in at least one of the spokes.

4. The apparatus of claim 3 further including identification means for distinguishing characteristics of each of said sectors.

5. The apparatus of claim 4 wherein the number of spokes is equivalent to the number of individually identifiable sectors.

6. The apparatus of claim 5 wherein the diameter of each of the hollow spokes is selected so that only one object in each spoke may come into contact with said inside peripheral wall at any one time.

7. The apparatus of claim 6 further including an identification peg projecting vertically in a second vertical plane parallel to said first vertical plane and adjacent to said face wall for determining a chosen sector, spoke and spherical object when said ring is at rest.

8. The apparatus of claim 7 wherein
the number of said spokes is ten and spaced thirty-six degrees apart from each adjacent spoke; and
the number of said passageways is ten and spaced thirty-six degrees apart from each adjacent passageway, and eighteen degrees from each adjacent divider means.

9. The apparatus of claim 8 wherein
each of said objects has an identification number within a range of "0–9" and
each of said sectors has an identification number within a range of "0–9".

10. The apparatus of claim 9 wherein
the number of objects is twenty.

11. The apparatus of claim 10 wherein
each of said spokes is comprised of a transparent material; and
the hub includes a front face wall of a transparent material.

12. The apparatus of claim 11 further including
a wagering board engaged to the support stand and projecting along a horizontal plane relative to said first vertical plane.

13. The apparatus of claim 12 wherein
the wagering board includes a grid with a plurality of individually identifiable board sectors, with the identification of each board sector being consistent with a combination of the identification numbers of one of said objects and one of said ring sectors.

* * * * *